US010029279B2

(12) United States Patent
Raksha

(10) Patent No.: US 10,029,279 B2
(45) Date of Patent: Jul. 24, 2018

(54) OPTICAL DEVICE HAVING AN ILLUSIVE OPTICAL EFFECT AND METHOD OF FABRICATION

(71) Applicant: VIAVI SOLUTIONS INC., Milpitas, CA (US)

(72) Inventor: Vladimir P. Raksha, Santa Rosa, CA (US)

(73) Assignee: VIAVI SOLUTIONS INC., Milpitas, CA (US)

( * ) Notice: Subject to any disclaimer, the term of this patent is extended or adjusted under 35 U.S.C. 154(b) by 0 days.

(21) Appl. No.: 15/406,590

(22) Filed: Jan. 13, 2017

(65) Prior Publication Data

US 2017/0165713 A1 Jun. 15, 2017

Related U.S. Application Data

(63) Continuation of application No. 14/228,069, filed on Mar. 27, 2014, now Pat. No. 9,579,879.

(60) Provisional application No. 61/805,672, filed on Mar. 27, 2013.

(51) Int. Cl.

| | |
|---|---|
| ***B41F 11/02*** | (2006.01) |
| ***B05D 3/00*** | (2006.01) |
| ***B05D 5/06*** | (2006.01) |

(52) U.S. Cl.

CPC ..... *B05D 3/207* (2013.01); *B05D 5/061* (2013.01); *B41F 11/02* (2013.01)

(58) Field of Classification Search

CPC ..... B42D 25/29; B42D 25/328; B42D 25/36; B42D 25/373; B41M 3/14; B41F 11/02; B05D 5/061

See application file for complete search history.

(56) References Cited

U.S. PATENT DOCUMENTS

| | | | |
|---|---|---|---|
| 3,791,864 | A | 2/1974 | Steingroever |
| 4,705,356 | A | 11/1987 | Berning et al. |
| 4,838,648 | A | 6/1989 | Phillips et al. |
| 5,571,624 | A | 11/1996 | Phillips et al. |
| 5,630,877 | A | 5/1997 | Kashiwagi |
| 6,376,018 | B1 | 4/2002 | Kittler, Jr. |
| 6,586,098 | B1 | 7/2003 | Coulter et al. |
| 6,759,097 | B2 | 7/2004 | Phillips et al. |
| 6,815,065 | B2 | 11/2004 | Argoitia et al. |

(Continued)

FOREIGN PATENT DOCUMENTS

| | | |
|---|---|---|
| CN | 1812886 | 8/2006 |
| CN | 102529326 | 7/2012 |

(Continued)

*Primary Examiner* — David Banh

(74) *Attorney, Agent, or Firm* — Mannava & Kang, P.C.

(57) ABSTRACT

A method is provided for manufacturing an image on a substrate, wherein the image includes an indicia and a frame. The method includes covering at least a portion the substrate with a carrier comprising magnetically alignable flakes, aligning the magnetically alignable flakes with a magnetic field of a magnetic assembly comprising a metal plate with an opening, and solidifying the carrier. The frame is formed at an edge of the opening and the indicia is visible within the frame. The magnetic assembly includes two magnets disposed so that the North pole of one magnet and the South pole of another magnet are proximate to the metal plate at opposite sides of the opening.

20 Claims, 7 Drawing Sheets

(56) References Cited

U.S. PATENT DOCUMENTS

| | | | | |
|---|---|---|---|---|
| 6,838,166 | B2 | 1/2005 | Phillips et al. | |
| 7,047,883 | B2 | 5/2006 | Raksha et al. | |
| 7,258,900 | B2 | 8/2007 | Raksha et al. | |
| 7,258,915 | B2 | 8/2007 | Argoitia et al. | |
| 7,528,900 | B2 | 5/2009 | Chang et al. | |
| 7,550,197 | B2 | 6/2009 | Kittler, Jr. et al. | |
| 8,343,615 | B2 | 1/2013 | Raksha et al. | |
| 8,633,954 | B2 | 1/2014 | Raksha et al. | |
| 2004/0009309 | A1 | 1/2004 | Raksha et al. | |
| 2004/0051297 | A1 | 3/2004 | Raksha | |
| 2005/0039859 | A1* | 2/2005 | Sugaya ..... | B32B 37/0053 156/583.1 |
| 2006/0198998 | A1 | 9/2006 | Raksha et al. | |
| 2007/0172261 | A1 | 7/2007 | Raksha et al. | |
| 2008/0014378 | A1 | 1/2008 | Hoffmuller et al. | |
| 2008/0069979 | A1 | 3/2008 | Raksha et al. | |
| 2008/0171144 | A1 | 7/2008 | Raksha | |
| 2010/0040845 | A1 | 2/2010 | Schmid | |
| 2013/0029112 | A1 | 1/2013 | Bargir | |
| 2014/0077485 | A1 | 3/2014 | Raksha et al. | |

FOREIGN PATENT DOCUMENTS

| | | |
|---|---|---|
| CN | 102555434 | 7/2012 |
| EP | 1990208 | 12/2008 |
| WO | WO 2011/092502 | 4/2011 |

* cited by examiner

OPTICAL DEVICE HAVING AN ILLUSIVE OPTICAL EFFECT AND METHOD OF FABRICATION

CROSS-REFERENCE TO RELATED APPLICATIONS

The present invention claims priority from U.S. Provisional Patent Application No. 61/805,672, filed Mar. 27, 2013, incorporated herein by reference.

TECHNICAL FIELD

The present invention relates generally to optically variable devices and, more particularly, to aligning or orienting magnetic flakes in a painting or printing process in order to obtain an illusive optical effect.

BACKGROUND OF THE INVENTION

Optically variable devices are used in a wide variety of applications, both decorative and utilitarian; for example, such devices are used as security devices on commercial products. Optically variable devices can be made in numerous ways to achieve a variety of effects. Examples of optically variable devices include holograms imprinted on credit cards and authentic software documentation, color-shifting images printed on banknotes and enhancing the surface appearance of items such as motorcycle helmets and wheel covers.

Optically variable devices can be made as a film or foil that is pressed, stamped, glued, or otherwise attached to an object, and can also be made using optically variable pigments. One type of optically variable pigment is commonly called color-shifting pigment because the apparent color of images appropriately printed with such pigments changes with the change of the angle of view and/or illumination. A common example is the numeral "20" printed with color-shifting pigments in the lower right-hand corner of a U.S. twenty-dollar bill, which serves as an anti-counterfeiting device.

Optically variable devices can also be made with magnetic pigments that are aligned with a magnetic field. After coating a product with a liquid composition, a magnet with a magnetic field having a desirable configuration is placed on the underside of the substrate. Magnetically alignable flakes dispersed in a liquid organic medium orient themselves parallel to the magnetic field lines, tilting from the original orientation. This tilt varies from normal to the surface of a substrate to the original orientation, which included flakes essentially parallel to the surface of the product. The planar oriented flakes reflect incident light back to the viewer, while the reoriented flakes do not.

A variety of methods have been suggested for forming images and security device which include magnetically aligned pigment flakes.

U.S. Pat. No. 5,630,877 in the name of Kashiwagi et al. discloses placing shaped magnets underneath a substrate and spraying the substrate with a paint containing magnetic particles. The resulting images are formed by narrow contour lines outlining the shapes of the magnets where the field lines bend.

U.S. Pat. No. 7,047,883 in the name Raksha et al. discloses alignment of magnetic particles, dispersed in organic binder and coated onto a substrate, between two poles of a horseshoe magnet or between north and south poles of two separated magnets 194, 196 as illustrated in FIG. 1. The magnets 194, 196 create magnetic field 192 with force lines 198 that are essentially parallel to the substrate 29, the magnetic field causes magnetic pigment flakes 26 in a fluid carrier 28 to flatten out.

WO2011092502 in the name of Bargir et al. discloses an apparatus (FIG. 2A) which includes a housing 13 placed inside of a block 15. The housing 13 has a curved upper surface 13*a* and a cavity 13*b* wherein a permanent magnet 12 is installed and covered with a magnetizable sheet 11. The magnet 12 is shaped such that its lateral periphery has the form of indicia; in FIG. 2A the magnet is a sphere. The sheet 11 acts as a focusing element for the magnetic field and concentrates the perturbations into the immediate lateral vicinity of the permanent magnet within the layer 20' as illustrated in FIG. 2B. This leads to a very sharp and well defined visual appearance of the indicia.

EP1990208 in the name of Gygi et al. discloses magnetic transfer of indicia to a coating composition P (FIG. 3A), such as an ink or varnish comprising magnetic pigments, applied to a sheet S. The device includes a body 20 exposed to a magnetic field generated by two permanent magnets 31 and 32. The body 20 consists of a support 22 and a shaped metal peace 21 engraved with a desirable pattern 21*a*-21*c*. The magnetic pigments align along the field lines and produce the appearance of engraved characters, such as a dark numeral in middle of a shiny oval of a security device shown in FIG. 3B. FIG. 3C illustrates the security device printed on a banknote.

The aforedescribed methods provide security patches unrelated to the graphical design of underlying documents in the sense that the patches may be placed anywhere on the document or transferred from one document to another. There is a security risk associated with possible transfer of a patch to a forged document. Accordingly, there is a need to mitigate the disadvantages of existing security patches and provide a new method of forming images including magnetically aligned pigment particles.

SUMMARY OF THE INVENTION

A method is provided for manufacturing an image on a substrate, wherein the image includes an indicia and a frame. The method includes covering at least a portion of a first surface of the substrate with a carrier comprising magnetically alignable flakes, aligning the magnetically alignable flakes with a magnetic field of a magnetic assembly comprising a metal plate having an opening, wherein the metal plate is disposed along a second surface of the substrate, and solidifying the carrier. The frame is formed at an edge of the opening and the indicia is visible within the frame.

In one aspect of the invention, the magnetic assembly includes two magnets disposed so that the North pole of one magnet and the South pole of another magnet are proximate to the metal plate at opposite sides of the opening.

A magnetic assembly for aligning magnetically alignable flakes dispersed in a carrier, includes a metal sheet with an opening, and first and second permanent magnets disposed so that a North pole of the first magnet and a South pole of the second magnet are proximate to the metal sheet at opposite sides of the opening. The magnetic assembly may be installed into a cylinder of a printing apparatus, such as a tensioner.

BRIEF DESCRIPTION OF THE DRAWINGS

The invention will be described in greater detail with reference to the accompanying drawings which represent preferred embodiments thereof, wherein.

DETAILED DESCRIPTION

Figure 4:
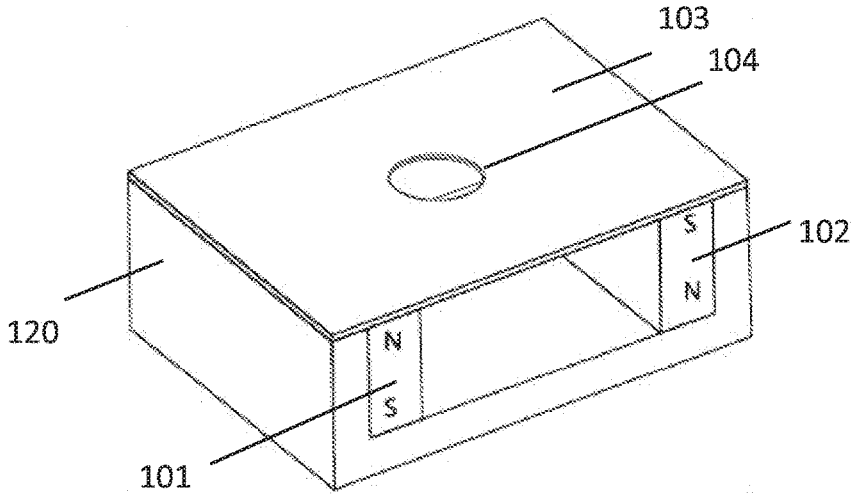
FIG. 4 is a schematic diagram of an apparatus.

With reference to FIG. 4, an apparatus for manufacturing an image formed by magnetically aligned pigment particles includes two magnets 101 and 102. The magnets may be enclosed in a magnetically-soft yoke 120 in order to minimize magnetic field losses. The magnets may be fixed in place by any other method, by using clamps or adhesive, etc. A magnetizable metal plate or sheet 103 is disposed on top of the magnets. Alternatively, the top ends of the magnets 101 and 102 may be at side edges of the plate 103, so that the plate 103 be disposed between and adjacent to an end of the magnet 101 and an end of the magnet 102.

The metal plate 103 has an opening 104 which may be of any desirable shape, e.g. a circle, a square, or a hexagon. The space between the magnets underneath the sheet metal 103 may be filled with any filler. The permanent magnets 101 and 102 are disposed so that the North pole of the magnet 101 and the South pole of the magnet 102 are proximate to, and preferably touch, the metal plate 103 at opposite sides of the opening 104, so that a line connecting the North pole of the magnet 101 and the South pole of the magnet 102 lies in the plane of the plate 103 and crosses the opening 104.

Figure 5:
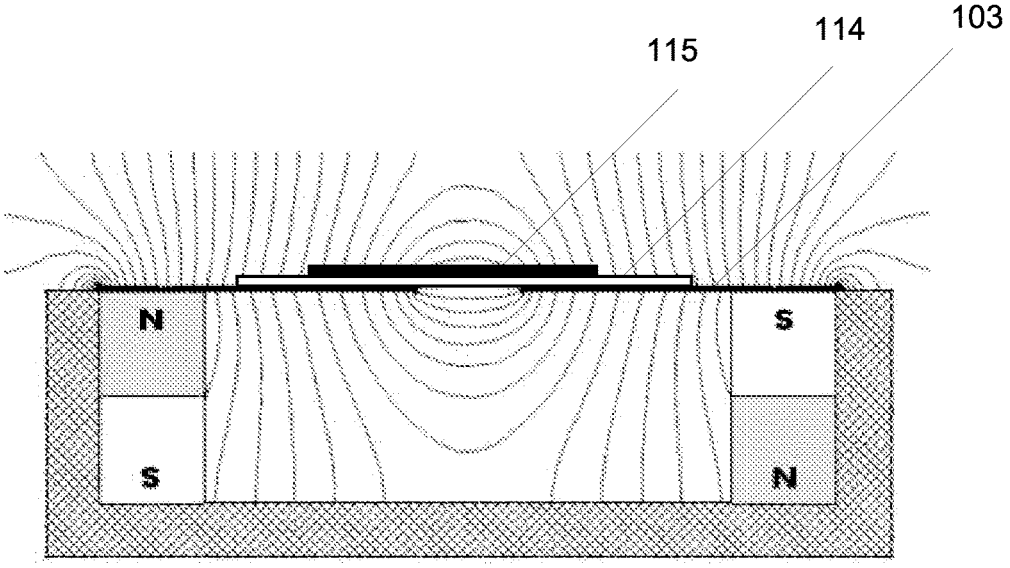
FIG. 5 is a schematic diagram of a magnetic field.

By way of example, the metal sheet 103 is a rectangular piece of Mu-metal with thickness of 0.006" and has a round hole in the middle. FIG. 5 presents a computer simulation of the magnetic field generated by the magnetic assembly shown in FIG. 4 in and around a printed ink 115 printed onto a substrate 114 disposed over the metal plate 103.

Figure 6:
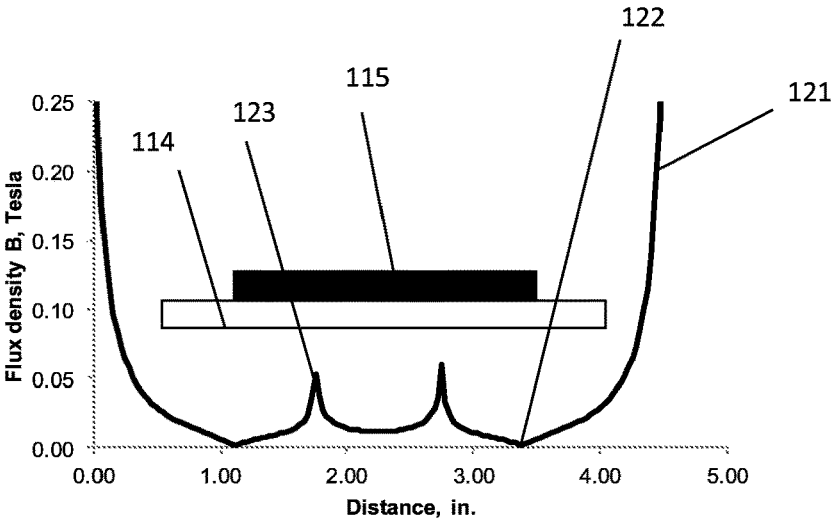
FIG. 6 is a plot of magnetic flux density.

Magnetic flux density along the surface of the sheet metal 103 is plotted in FIG. 6. The plot demonstrates that the flux density has the highest (0.25 T) value 121 close to the edges of the sheet metal 103 where it touches the magnets 101 and 102. The flux density decreases almost to zero at a half-way point 122 to the hole 104 in the middle of the sheet 103 of the Mu-metal, but starts to grow again with reduction of the distance to the edge 123 of the hole 104 where it is reaching value of 0.05 T.

The magnetic assembly which includes a metal plate with an opening, such as illustrated in FIG. 4, may be used for forming an image having an indicia surrounded by a frame formed of aligned pigments al an edge of the opening in the metal plate. The indicia may include a symbol, a logo, or a small image, and may be printed in regular ink, or in the same ink which is used for forming the frame. The opening should be wide enough (e.g. at least 8 mm wide) so that the frame would be large enough to include the indicia visible to a naked human eye. The indicia surrounded by the frame may be printed on a banknote substrate. The indicia and the frame-forming coaling may be printed or painted using conventional techniques.

Figure 7:
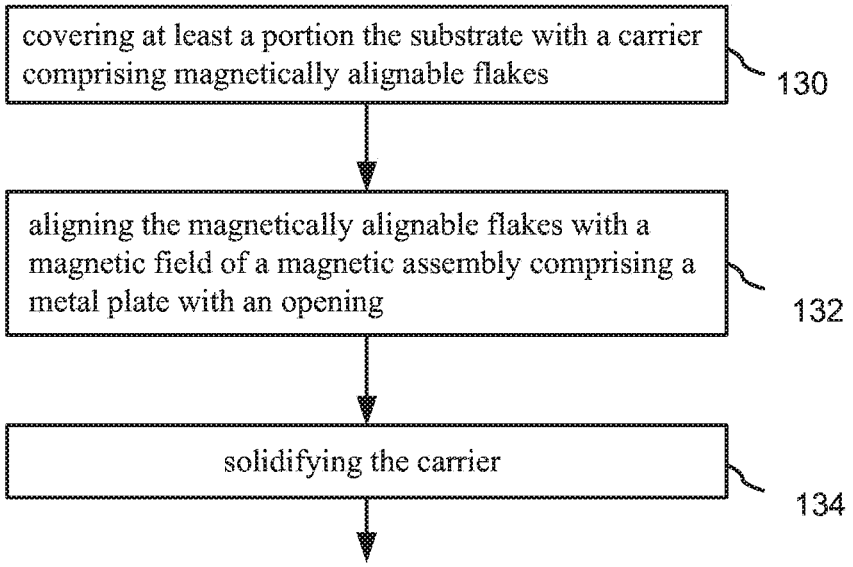
FIG. 7 is a flow chart of a method of manufacturing an image.

FIG. 7 is a flow chart of a method of manufacturing an image which includes an indicia and a frame. The method includes a substrate covering step 130: covering at least a portion the substrate with a carrier comprising magnetically alignable flakes which constitute the ink or paint. By way of example, the ink or paint 115 in a liquid or paste form is provided onto the substrate 114 during the substrate covering step 130. The concentration of magnetically alignable flakes in the ink or paint is preferably in the range of from 4 wt % to 40 wt %.

The substrate may be a paper, plastic, or cardboard substrate, etc., and the resulting article may be a banknote, a credit card, or any other object thereto magnetically alignable flakes are applied as described herein. The carrier with the magnetically alignable flakes dispersed therein may be coated in separated regions of the substrate or as a continuous layer. The carrier may be a light transmissive, preferably clear, UV-curable binder. The flakes may be any pigments which include a magnetic or magnetizable material, such as multilayer thin film magnetically alignable flakes, reflective magnetically alignable flakes, diffractive magnetically alignable flakes, or any other special effect magnetically alignable flakes. However, the pigments produced by the vacuum technology are more preferable because they provide brightest appearance of the print. Pigments, produced by chemical methods, can also be used for this purpose.

Magnetically alignable pigment flakes may be formed of one or more thin film layers, including a layer of permanently magnetic or magnetizable material such as Nickel, Cobalt, and their alloys. The term "magnetic" is often used to include permanently magnetic as well as magnetizable materials, pigment flakes, inks, etc. In the pigment flakes, the magnetic layer may be hidden between two reflector layers, preferably made of Aluminum. Additionally, a dielectric layer may be provided on each reflector layer, and an absorber layer—on each dielectric layer, thus forming color-shifting flakes. Various thin-film flakes and methods of their manufacturing are disclosed e.g. in U.S. Pat. Nos. 5,571,624, 4,838,648, 7,258,915, 6,838,166, 6,586,098, 6,815,065, 6,376,018, 7,550,197, 4,705,356 incorporated herein by reference.

The pigment flakes are essentially planar, however may include symbols or gratings. The flakes have a thickness of between 50 nm and 2,000 nm, and a length of between 2 microns and 200 microns. Preferably, the length of the flakes is in the range of 5-500 microns, and the thickness in the range of 50 nm to 5 microns. The flakes may have an irregular shape. Alternatively, shaped flakes such as square, hexagonal, or other selectively-shaped flakes may be used to promote coverage and enhanced optical performance. Preferably, the pigment flakes are highly reflective flukes having at least 50%, and preferably 70%, reflectivity in the visible spectrum.

The pigment flakes are conventionally manufactured using a layered thin film structure formed on a flexible web, also referred to as a deposition substrate. The various layers are deposited on the web by methods well known in the art of forming thin coating structures, such as Physical and Chemical vapor deposition and the like. The thin film structure is then removed from the web material and broken into thin film flakes, which can be added to a polymeric medium such as various pigment vehicles (binders) for use as ink, paint, or lacquer which are collectively referred herein as "ink", and may be provided to a surface of a substrate by any conventional process referred herein as "printing". The binder is preferably a clear binder, but may be tinted with a low amount of conventional dye, and may include a low amount of admixtures, e.g. taggent non-magnetic flakes having a symbol thereon.

In an alignment step 132, the flakes are aligned with a magnetic field of a magnetic assembly comprising a metal plate with an opening while the substrate is disposed over the metal plate. In our example, the magnetic assembly includes the plate 103 with the opening 104 as shown in FIG. 4. The thickness of the metal sheet (a diverter) may vary in a wide range and is defined by configuration of the field and the grade of the magnet, as discussed in U.S. patent application Ser. No. 13/737,836, incorporated herein by reference for all purposes. Preferably, the metal sheet 103 has a thickness in the range of from 0.004" to 0.1" and is made of a material having a permeability in the range of from 0.01 to 0.3 H/m, such as permalloy, mu-metal, pure iron, or supermalloy. During the alignment step, the substrate is disposed along the metal plate so that the metal plate is proximate and essentially parallel to a surface of the substrate opposite to the surface whereto the magnetic ink has been applied. The two surfaces may be in direct contact. In a printing apparatus discussed further with reference to FIGS. 12A and 12B, the substrate and the metal plate may move together for a period of time while being close and parallel to each other.

Within the ink or paint, the magnetically alignable flakes are oriented with application of a magnetic field produced by one or more permanent magnets or electromagnets. Generally, the flakes tend to align along the magnetic lines of the applied field while the ink is still wet. Preferably, the ink is solidified when the printed image is still in the magnetic field. Various methods of aligning magnetically alignable flakes are disclosed e.g. in U.S. Pat. Nos. 7,047,883 and 8,343,615, both incorporated herein by reference. Advantageously, the magnetic alignment of the flakes may be performed as part of a high-speed printing process. A printed image may move on a support, e.g. a belt or plate, in proximity of a magnetic assembly at a speed of from 20 ft/min to 300 ft/min.

Figure 4A:
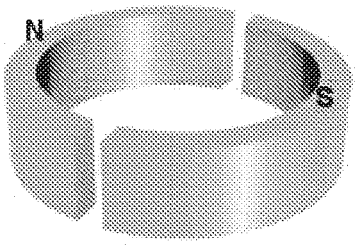
FIGS. 4A and 4B are schematic diagrams of magnets in a magnetic assembly.
Figure 4B:
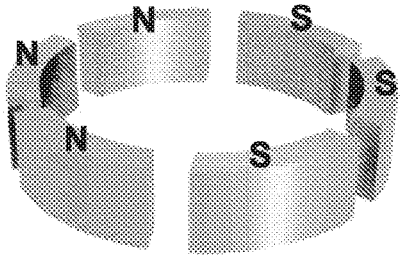

The magnetic assembly preferably has two oppositely oriented magnets or groups or magnets as shown in FIGS. 4, 4A and 4B. The magnets may be placed under or above the bell or plate, or embedded into a roller used in a printing apparatus as discussed below. The metal plate preferably has an essentially planar surface which includes a possibility of a slight curvature to correspond the curved surface of a cylinder of the printing apparatus.

The pigment flakes, after being magnetically aligned, form a frame pattern at least partially surrounding the indicia.

In a solidifying step 134, the carrier is solidified so as to fix the flakes in their aligned positions within the solidified carrier. Any suitable method for solidifying the carrier may be applied, e.g. drying, or using UV or e-beam or microwave irradiation.

At the alignment step 132, the force lines of the magnetic field bend at the edge of the opening in the metal plate. Accordingly, the aligned flakes form a frame pattern at the edge of the opening; the pattern reflects incident light so as to produce a bright frame.

The frame formed of the magnetically aligned flakes should be in register with the indicia so that in the resulting image the indicia be visible within the frame.

In one embodiment, the indicia is printed or painted on the substrate prior to covering at least the portion the substrate with the carrier with magnetically alignable flakes in the substrate covering step 130. The indicia may be not covered with the ink or paint (the carrier containing the flakes), or the ink/paint coating may have a hole above the indicia. By way of example, the substrate 114 in the form of a banknote substrate having a numeral "10" in the middle of a secure guilloche pattern 141 (FIG. 8) was covered with the layer of wet ink 115 containing magnetically alignable flakes. The ink coating was applied in a ring shaped region so that the region containing the numeral "10" was not covered with the magnetic ink. The ink-covered substrate was placed on top of the Mu-metal sheet 103 and the hole 104 was registered to the graphical image in the banknote. After the alignment step 132, magnetic particles aligned along magnetic lines bending al the edges of the hole creating a convex annular reflector. In other portions of the ink coating, removed from the edge of the opening 104 in the magnetizable sheet 103, the flakes didn't have any alignment along the Mu-metal plate 103. The annular reflector formed by the aligned flakes creates a real image of a light source. Considering that the reflector has an annular shape, it creates the illusory impression that the round region 142 in FIG. 8 had been embossed toward the observer. The illusive height of the embossing in the particular example was close to 0.0625".

Figure 9:
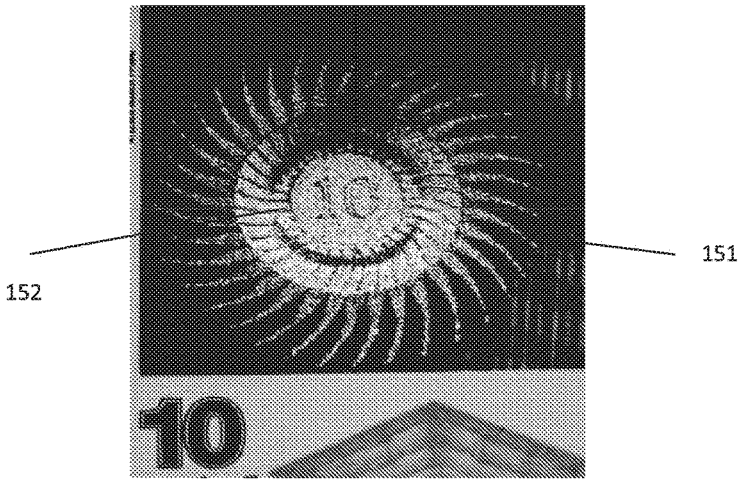
FIG. 9 is a photograph of an article.

With reference to FIG. 9, a background in the form of a sunburst pattern 151 and a numeral "10" was printed first on a paper substrate with ink containing Gold/Green color-shifting pigment. Then, in the substrate covering step 130, a ring 152 was printed on the top of the sunburst with a carrier containing magnetically alignable Gold/Green color-shifting pigments. The paper was placed on top of the magnetic assembly shown in FIG. 4, and the pigment were aligned in the magnetic field (step 132), and the ink was solidified by curing with UV light when the field was still applied (step 134).

In one embodiment, the indicia is printed or painted on the substrate after covering at least the portion the substrate with the carrier with magnetically alignable flakes in the substrate covering step 130, preferably after the solidifying step 134. The indicia may be printed over the coating of the ink or paint used for forming the frame. In other words, the indicia may be printed into the center of the frame.

In yet another embodiment, the indicia is formed during the covering step 130 by inverse printing, wherein the ink or paint does not cover the indicia, but covers the adjacent region(s) and thus defines the contour of the indicia.

The opposite orientation of the two magnets as shown in FIG. 4, wherein the magnets are disposed so that a North pole of one magnet and a South pole of another magnet are proximate to the metal plate 103 at opposite sides of the opening 104, ensures that, in the opening of the plate, the force lines of the magnetic field are mostly parallel to the surface of the plate 103 and only bend at the edge of the opening 104. Accordingly, the magnetic flakes are aligned in a curved frame pattern at the edge of the opening and essentially parallel to the surface of the substrate within the opening 104.

Figure 10:
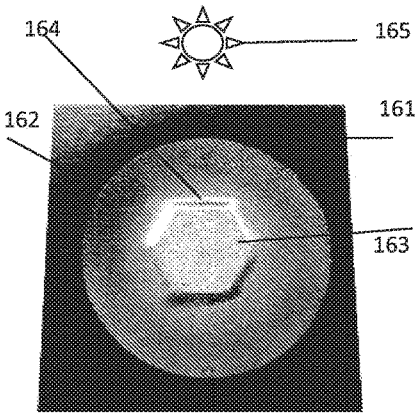
FIG. 10 is a photograph of an article.
Figure 11:
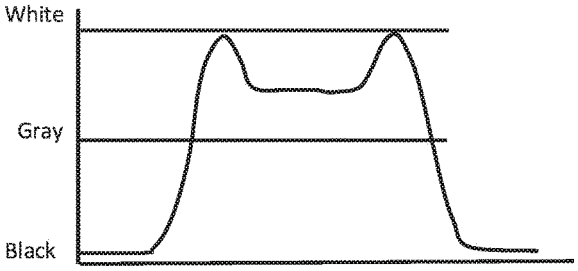
FIG. 11 is a plot of brightness of an image.

With reference to FIG. 10, a mu-metal sheet was cut with a hexagonal hole and placed on the top of two magnets as illustrated in the FIG. 4. As discussed above with reference to FIG. 7, a circle 162 on a black card (substrate) 161 was printed with magnetic ink containing magnetically alignable flakes in a carrier. The flakes were aligned along the fines of the magnetic field, and the ink was cured. The particles were aligned at steep angles close to the edge of the circle 162 and at low angles at the edge of the hexagonal cut in the metal. Because of the low tilt within the opening, the image of a hexagon 163 is very bright. A border 164, separating the hexagon and the area of the circle, has the brightest appearance from the side of the source of incident light 165. The outer region of the circle 162 is dark because the particles there are almost perpendicular to the surface of the paper. Differentiation of the image brightness across the circle 162 is illustrated in FIG. 11. The image is black in the outer portion of the region 162. The brightness increases rapidly as the scan approaches the border 164 and drops slightly at the central part of the hexagon. The similar optical effect is observes in the sample illustrated in FIG. 8.

Figure 1:
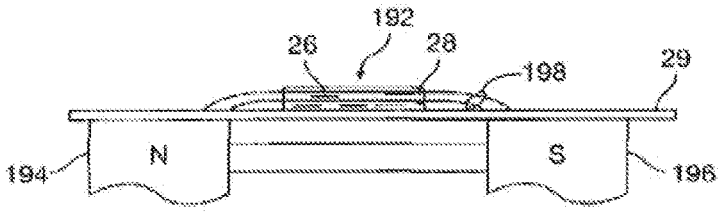
FIG. 1 (prior art)
FIG. 1 is a simplified side view of an apparatus for aligning magnetic pigment flakes to the plane of the substrate after printing.
Figure 2A:
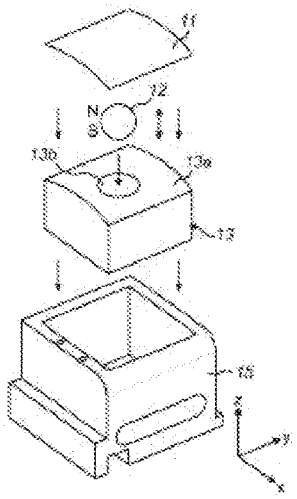
FIG. 2A (prior art)
FIG. 2A is a schematic diagram of an apparatus for magnetically imprinting indicia.
Figure 2B:
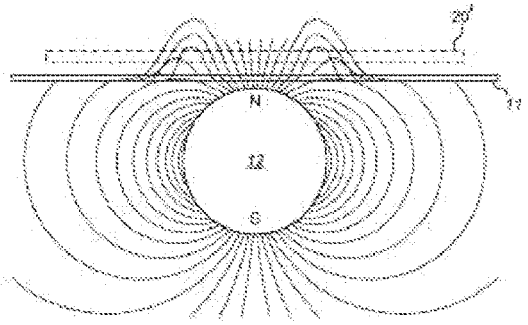
FIG. 2B (prior art)
FIG. 2B is a schematic diagram of the magnetic field established by the apparatus of FIG. 2A.
Figure 3A:
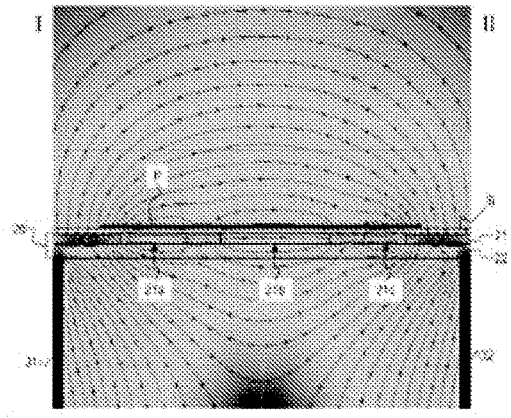
FIG. 3A (prior art)
FIG. 3A is a schematic diagram of a magnetic field.
Figure 3B:
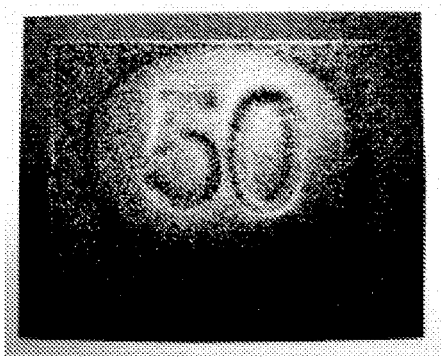
FIG. 3B (prior art)
FIG. 3B is photograph of a magnetically-induced pattern.
Figure 3C:
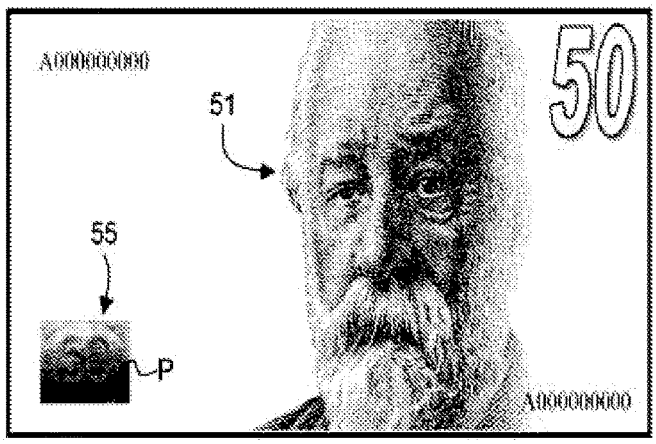
FIG. 3C (prior art)
FIG. 3C is a schematic illustration of a banknote comprising the magnetically-induced pattern illustrated in FIG. 3B.

With reference to FIG. 10, the relatively large size of the opening in the metal plate, at least 8 mm wide, allows for the bright central region to become visible to an unaided human eye, differently from the narrow lines shown in FIG. 3B, which are absent such a bright region, and appear embossed into the surface of the printed device. The device shown in FIG. 10 may be used as an illusive optical printed device per se, of may be used for forming an image including an indicia and a frame. The indicia may be printed within the bright region 163, which of course may be of a different shape, on top of the magnetic ink. Alternatively, the magnetic ink may be absent at the internal portion of the region 163 (as in the device shown in FIG. 8), and the indicia may be printed therein either prior or after printing the magnetic ink. The border 164 and a portion of the region 163 where the magnetic ink has been provided form the bright frame surrounding the indicia. The frame appears protruding from the substrate. In our experiments, the frame appeared to be about 1 mm high.

A magnetic assembly including a plate with an opening and two oppositely oriented magnets as illustrated in FIG. 4 may be installed into a cylinder within a printing apparatus so that the metal plate is disposed at the surface of the cylinder, preferably flash with the surface of the cylinder, and a belt supporting a substrate with a wet image bends around the cylinder so that the image moves for a period of time together with the magnetic assembly. The substrate may be a continuous sheet of paper, plastic film, or laminate. The cylinder, which includes the magnetic assembly, may be a print cylinder, an impression roller, or a tensioner.

Figure 12A:
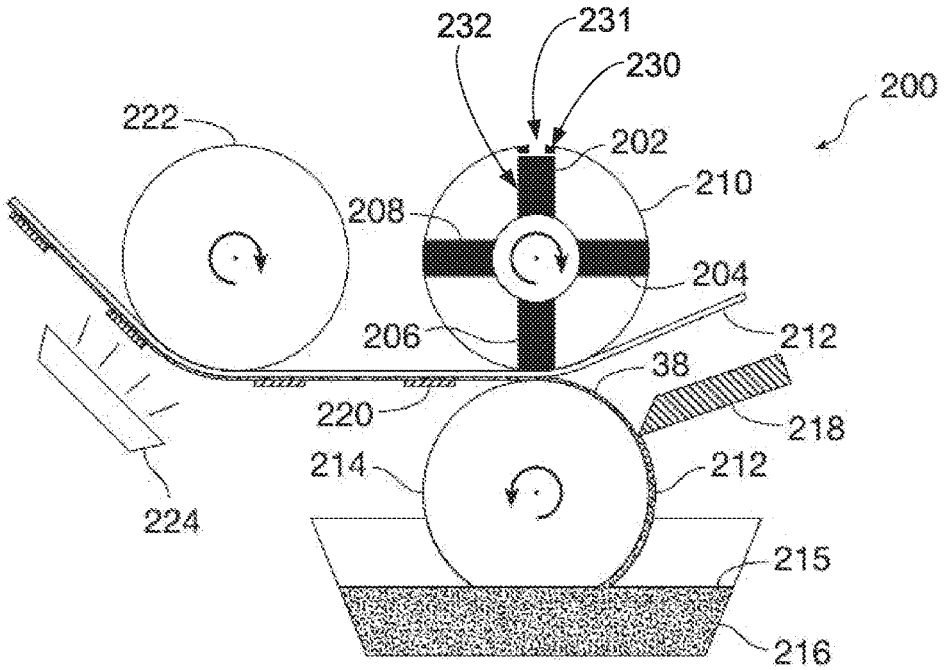
FIG. 12A is a simplified side view schematic of a printing apparatus according to an embodiment of the present invention; and, FIG. 12B is a simplified side view schematic of a printing apparatus according to another embodiment of the present invention.

FIG. 12A is a simplified side-view schematic of a portion of a printing apparatus 200 according to an embodiment of the present invention. Magnetic assemblies 202, 204, 206, 208 are located inside an impression roller 210. The magnetic assembly 202 includes a metal plate 230 with al opening 231 at the surface of the roller 210, and magnets 232 under the plate (as shown for the assembly 202) or at side edges of the plate (not shown). Other magnetic assemblies 204, 206, and 208 may have a same structure as the assembly 202. The number of magnetic assemblies may vary depending on the size of the cylinder.

The substrate 212, such as a continuous sheet of paper, plastic film, or laminate, moves between the print cylinder 214 and the impression roller 210 at high speed. The print cylinder takes up a relatively thick layer 212 of liquid or paste-like paint or ink 215 containing magnetic pigment from a source container 216. The paint or ink may be spread to the desired thickness on the print cylinder with a blade 218. During printing of an image between the print cylinder 214 and impression roller 210, the magnetic assemblies in the impression roller 210 orient (i.e. selectively align) the magnetic pigment flakes in at least part of the printed image 220. A tensioner 222 is typically used to maintain the desired substrate tension as it comes out of the impression roller and print cylinder, and the image on the substrate is dried with a drier 224. The drier could be heater, for example, or the ink or paint could be UV-curable, and set with a UV lamp.

Figure 12B:
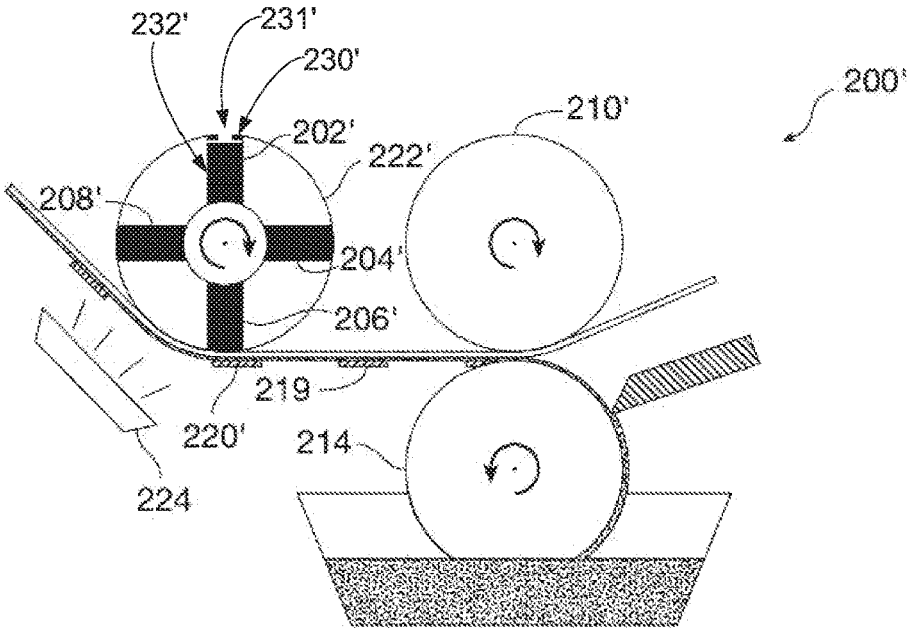

FIG. 12B is a simplified side view schematic of a portion of a printing apparatus 200' according to another embodiment of the present invention. Magnetic assemblies 202', 204', 206', 208' are installed in the tensioner 222' or other roller. The number of magnetic assemblies may vary depending on the size of the roller. The magnetic assembly 202' includes a metal plate 230' with at opening 231' at the surface of the roller 222', and magnets 232' under the plate (as shown for the assembly 202') or at side edges of the plate (not shown). Other magnetic assemblies 204', 206', and 208' may have a same structure as the assembly 202'.

The magnets orient the magnetic pigment flakes in the printed images before the fluid carrier of the ink or paint dries or sets. A wet printed image 219 comes off the impression roller 210' and print cylinder 214 with flakes in a non-selected orientation, and a wet image 220' is oriented by a magnetic assembly 206' in the tensioner 222' before the flakes are fixed. The drier 224 speeds or completes the drying or curing process, preferably while the flakes are still in the magnetic field of the assembly 206'. The drier could be heater, for example, or the ink or paint could be UV-curable, and set with a UV lamp.

The apparatuses illustrated in FIGS. 12A and 12B may be used for manufacturing the image shown in FIG. 11. Relative to the images shown in FIGS. 8 and 9, the printing apparatus 200 or 200' perform the alignment step 132, and the indicia may be printed prior to or after the alignment step as discussed above. A mask may be disposed between the printing cylinder 214 and the substrate 212 for printing e.g. the ring of magnetic ink as discussed above with reference to FIG. 8.

Figure 8:
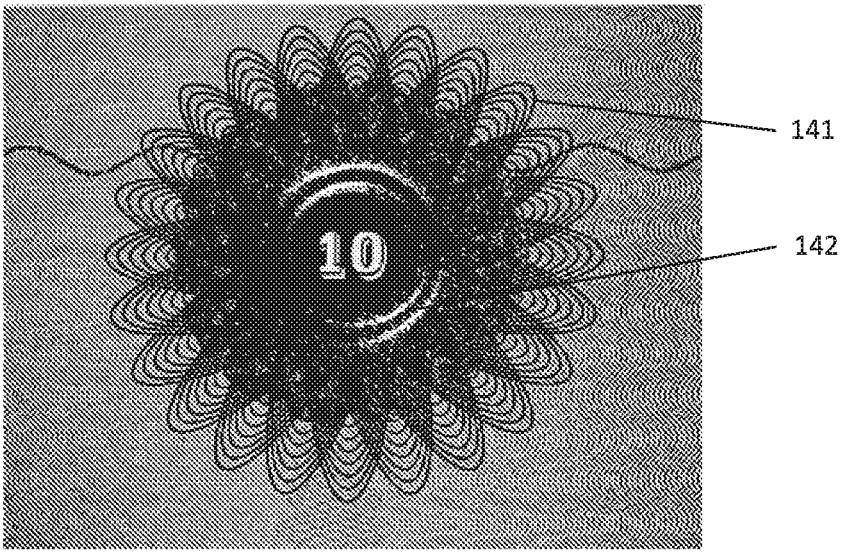
FIG. 8 is a photograph of an article.

The aforedescribed method advantageously combines optical effects generated by magnetically aligned flakes with conventional printed graphical images. The illusively embossed frames simultaneously serve as security features per se, because they are difficult to reproduce, as decorative elements for their spectacular optical effects, as well as for attracting a human eye to the image surrounded by the frame, the way guilloche patterns highlight denomination numerals on banknotes. The method allows fabrication of advanced optical security devices for documents of value such as banknotes wherein the magnetically aligned feature is part of the integrated banknote design. The documents have improved security and visual appeal when the magnetically oriented part of the graphical image (the frame) is registered with a corresponding graphical image (the indicia) on the banknote as illustrated in FIGS. 8 and 9.

I claim:

1. An apparatus for aligning magnetically alignable flakes dispersed in a carrier, comprising a metal sheet with an opening, and first and second permanent magnets disposed so that a North pole of the first permanent magnet and a South pole of the second permanent magnet are proximate to the metal sheet at opposite sides of the opening, wherein a magnetic flux density along a surface of the metal sheet is lowest at a half-way point to the opening in a middle of the metal sheet and increases on both sides of the middle towards an end of the metal sheet and towards the opening in the metal sheet.

2. The apparatus as defined in claim 1, wherein the metal sheet has a thickness in the range of from 0.004 inch to 0.1 inch.

3. The apparatus as defined in claim 1, wherein the metal sheet comprises a material having permeability in the range of from 0.01 to 0.3 H/m.

4. The apparatus as defined in claim 1, wherein the opening has a shape of a circle, a square, or a hexagon.

5. The apparatus as defined in claim 1, further comprising a cylinder, wherein the metal sheet is at the surface of a cylinder.

6. The apparatus as defined in claim 1, wherein the first permanent magnet and the second permanent magnet are enclosed in a magnetically-soft yoke.

7. The apparatus as defined in claim 1, wherein the metal sheet is disposed on top of the first and second permanent magnets.

8. The apparatus as defined in claim 1, wherein the metal sheet is disposed between the North pole of the first permanent magnet and the South pole of the second permanent magnet.

9. The apparatus as defined in claim 1, wherein the North pole of the first magnet and the South pole of the second magnet lie in a plane of the metal sheet and the opening.

10. The apparatus as defined in claim 1, wherein the metal sheet is disposed below the top of the first and second permanent magnets.

11. The apparatus as defined in claim 1, wherein the metal sheet is embedded into a roller.

12. The apparatus as defined in claim 1, wherein the metal sheet has a planar surface.

13. The apparatus as defined in claim 1, wherein the metal sheet has a curved surface.

14. The apparatus as defined in claim 1, wherein the first permanent magnet and the second permanent magnet create a magnetic field that bends at an edge of the opening in the metal sheet.

15. The apparatus as defined in claim 1, wherein the first permanent magnet and the second permanent magnet create a magnetic field that is parallel to a surface of the metal sheet within the opening.

16. The apparatus as defined in claim 1, wherein the opening is at least 8 mm wide.

17. The apparatus as defined in claim 5, wherein the cylinder includes at least one metal sheet, at least one first permanent magnet, and at least one second permanent magnet.

18. The apparatus as defined in claim 17, wherein a number of metal sheets, first permanent magnets, and second permanent magnets varies depending on a size of the cylinder.

19. The apparatus as defined in claim 17, wherein the cylinder includes four of each of the metal sheet, first permanent magnet, and second permanent magnet.

20. The apparatus as defined in claim 1, further comprising a belt supporting a substrate to be printed.

* * * * *